United States Patent [19]

Oshima et al.

[11] 4,417,533

[45] Nov. 29, 1983

[54] SPRING BIASED PRESSER FOOT

[75] Inventors: Nobuyasu Oshima; Tetsuya Tsumura, both of Nagoya, Japan

[73] Assignee: Brother Kogyo Kabushiki Kaisha, Nagoya, Japan

[21] Appl. No.: 225,031

[22] Filed: Jan. 12, 1981

[30] Foreign Application Priority Data

Jan. 31, 1980 [JP] Japan ..... 55-10769
Feb. 8, 1980 [JP] Japan ..... 55-14943

[51] Int. Cl.[3] ..... D05B 29/00
[52] U.S. Cl. ..... 112/235
[58] Field of Search ..... 112/235, 237, 238

[56] References Cited

U.S. PATENT DOCUMENTS 2,016,354 10/1935 Workman ..... 112/235
2,629,352 2/1953 Paulsen ..... 112/235 X
3,089,447 5/1963 Shuman ..... 112/235

FOREIGN PATENT DOCUMENTS 674078 3/1939 Fed. Rep. of Germany ..... 112/235
1162670 2/1964 Fed. Rep. of Germany ..... 112/235

*Primary Examiner*—Werner H. Schroeder
*Assistant Examiner*—Andrew M. Falik
*Attorney, Agent, or Firm*—Browdy and Neimark

[57] ABSTRACT

A work presser device wherein a constant-force spring is employed for urging a presser bar downwardly, with substantially constant pressure, against a work piece. This constant pressure is exerted regardless of the axial movement of the presser bar owing to variation of the thickness of the work piece in the course of a sewing operation.

4 Claims, 6 Drawing Figures

SPRING BIASED PRESSER FOOT

FIELD OF THE INVENTION

This invention relates to an improvement of a work presser device for a sewing machine, and more particularly to a work presser device which is constantly capable of pressing a work piece with a constant pressure independently of variation in the thickness of work piece or difference in shape of interchangeably used presser feet.

BACKGROUND OF THE INVENTION

In ordinary work presser devices, wherein a presser foot is attached to the lower end of a presser bar, a work piece is urged onto a feed dog by the presser foot with a pressure which is determined by a resilient force of a spring for downwardly urging the presser bar. As the work piece is fed by the feed dog under the action of the pressure, the work feeding operation by the feed dog is greatly influenced by the magnitude of this work pressure.

In most conventional work presser devices a compression coil spring has been employed as the above-mentioned spring means or biasing means. Two types of such devices, for example, a spring force adjustable type manipulatable by an operator and a non-adjustable type. In the former, the work piece can be subjected to a pressure optionally set, by a manual operation, of the sewing operator according to thickness and kind of the work piece as well as type of stitching. In the latter, the work piece is subjected to a non-adjustable pressure chosen by the machine manufacturer as the best average setting for common materials.

In either of the two types, however, the work pressure varies due to axial movement of the presser bar according to thickness of the work piece, which could disturb a smooth sewing operation when forming fine stitches. When, for example, a work piece of large thickness, such as jeans, is sewn starting at one edge thereof, or when a stepped portion of the work piece, having several folds, comes into abutment with the tip of a presser foot in the course of sewing operation, the presser foot is inclined by being rotated about a pin or pivot and a presser bar is accordingly lifted. This results in a wedge-shaped clearance being formed between the lower surface of the presser foot and the upper surface of a feed dog or a throat plate, accompanied by a sudden increasing of the work pressure. Under this condition, feeding or advancing of the work piece becomes consequently difficult and stitching is repeated at the same place, thereby producing a lump or knot of stitches and causing great difficulty in the sewing operation.

For the purpose of eliminating these disadvantages a work presser device has been already proposed wherein the presser foot is, at the moment when the tip portion thereof is abutted on the stepped portion of the work piece, forcibly rotated to return its position to horizontal. In such a device, the feeding or advancing of the work piece by the feed dog will be undoubtedly eased. Structure of the device in this proposition will be however complicated, and the work pressure inevitably increases and deviates from the optimum value.

Another proposition for a work presser device capable of eliminating the earlier mentioned disadvantages is by use of an automatic pressure regulating device, wherein the work pressure is able to be maintained by an electrical servo mechanism at a certain desired value set in advance of the sewing operation, even when the presser bar is raised due to the presence of a stepped portion in the course of the sewing operation. The work presser device of this type is also liable to be complex in structure and high in production cost.

SUMMARY OF THE INVENTION

It is therefore a primary object of this invention to solve the problems in the prior art by means of a simple scheme. More particularly, a main object of this invention to provide a work presser device which is simple in structure and constantly capable of pressing the work piece, without any adjustment operation, at a certain fixed pressure independently of any axial movement of the presser bar due to thickness variation of the work piece.

It is another object of this invention to provide a work presser device wherein a sewing operator can easily adjust the work pressure, so that once manually set by the operator, it will not substantially vary irrespective of the axial movement of the presser bar due to the thickness variation in the work piece. In this way, the work presser device easily adjusts the work pressure and consequently allows a smooth sewing operation.

These objects can be achieved by employing a constant-force spring as the means for downwardly urging the presser bar. The constant-force spring has a spring force which remains substantially constant, so long as its deflection varies in accordance with the distance and the positional relation between either attaching end of the spring within a predetermined range.

In the work presser device of this invention, adoption of a constant-force spring as a means for downwardly urging the presser bar has made it possible that the work pressure applied on the work piece by the presser foot can be maintained substantially constant regardless of the axial movement of the presser bar due to variation in the thickness of the work piece. This device is particularly effective in sewing a work piece which contains stepped portions therein or in starting a sewing at one edge of a work piece which is relatively thick.

DETAILED DESCRIPTION OF THE PREFERRED EMBODIMENTS

Figure 1:
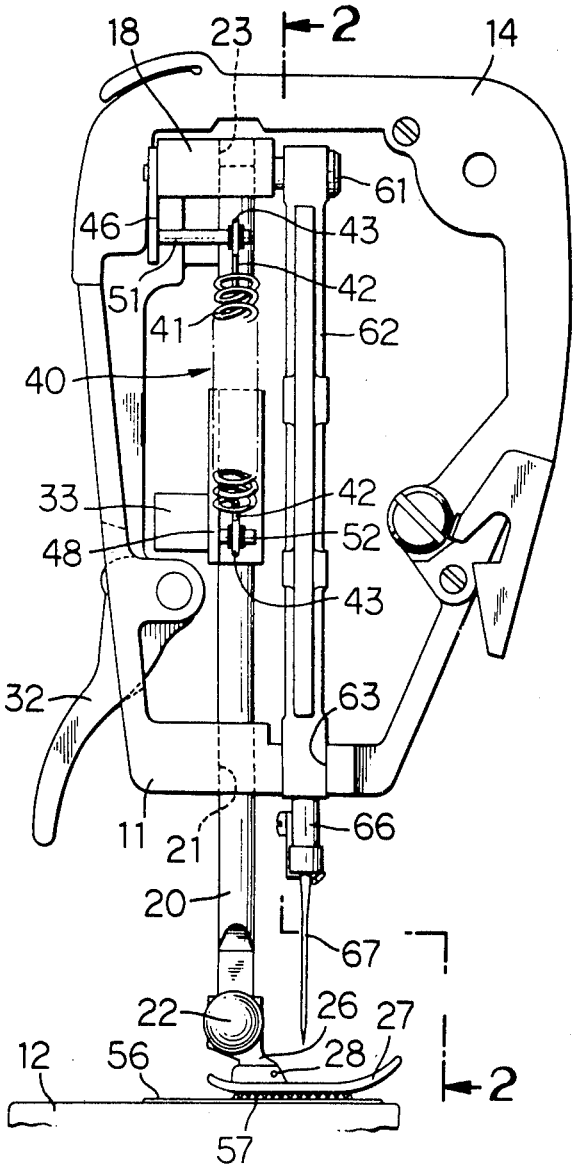
FIG. 1 is a side view of a first embodiment of a work presser device, with a face plate removed, in accordance with this invention.
Figure 2:
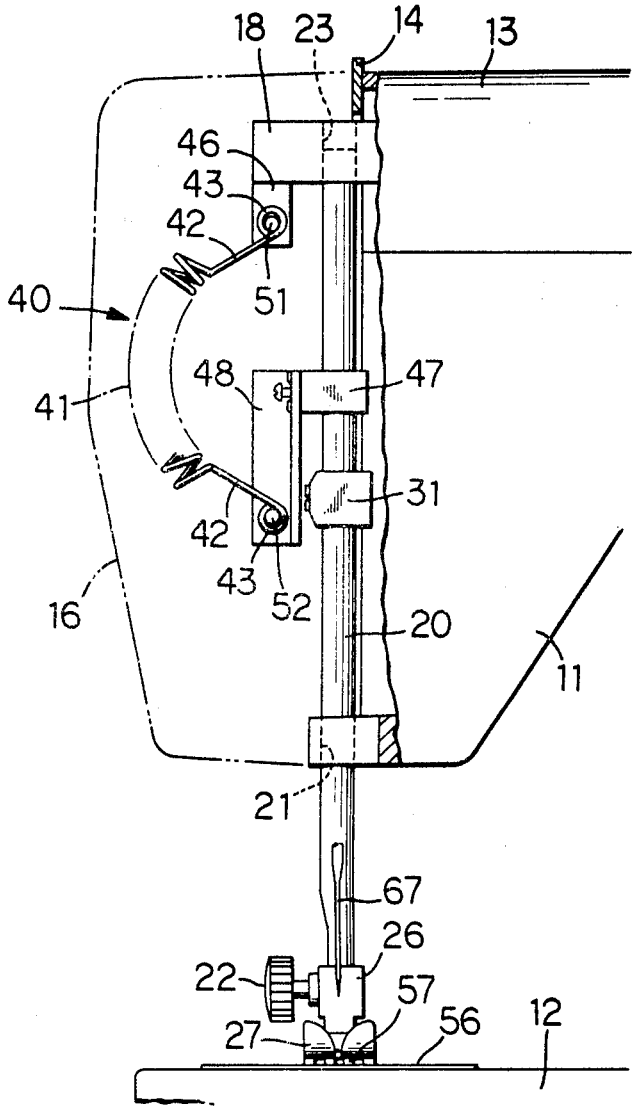
FIG. 2 is an elevational view of the embodiment of FIG. 1 seen along the line 2—2 in FIG. 1.

A hollow arm 11, shown in FIGS. 1 and 2, is horizontally extending above a bed 12 and covered at the top thereof by a top cover 13. To an attaching plate 14 of a head portion a face plate 16 is pivoted in a rearwardly openable state.

A presser bar 20 vertically extends through the head portion of the hollow arm 11 and is slidably fitted, at the middle and upper portion thereof, into through-bores 21 and 23 formed in the hollow arm 11 and the protruding portion 18. On the lower end of the presser bar 20, a presser holder 26 is removably mounted by fastening screw 22, and a presser foot 27 is attached to the presser holder 26 by a pin 28 for rotation about the pin within a certain angle range.

Between the protruding portion 18 and the presser bar 20, a bent coil spring 40, designed as a constant-force spring, is anchored or spanned, which consists of a coil portion 41 and a pair of arm portions 42 on either end thereof. The end of each of the arm portions 42 is respectively formed into an engaging portion 43, such as a loop or hook (see FIG. 2), by being annularly bent. The engaging portions 43 are rotatably connected to the protruding portion 18 and the presser bar 20. The engaging portions 43 are respectively fitted in vertical alignment on pins 51 and 52 which are respectively secured to an anchoring plate 46 of flat plate shape attached to the protruded portion 18 and another anchoring plate 48 of L-shaped cross sectional configuration attached to a block 47 fixed to the presser bar 20. The bent coil spring 40 in its natural, undeformed state is straight and linear in the coil portion 41, being closely wound coil to coil, and a certain angle is formed between the body portion 41 and the arm portions 42. The coil spring 40 is of arcuate form as a whole in the mounted state, as shown in FIG. 2, for downwardly urging the presser bar 20.

A presser bar bracket 31 is fixed to the presser bar 20 beneath the block 47. An extension 33 of the presser bar bracket 31 is engageably positioned with respect to a cam surface of a presser lifting lever 32 which is pivoted on the hollow arm 11. Thus, the presser bar 20 can be vertically moved by rotative movement of the lever 32.

On the bed 12 a throat plate 56 is attached opposite to the presser foot 27. A feed dog 57 is so disposed under the throat plate 56 to execute feeding or advancing movement for a work piece by cooperating with the throat plate 56.

A needle bar gate 62 is pivotally connected, at the upper end thereof with a pivot pin 61 connected to the protruding portion 18, so as to be laterally swingable in a guided state at the lower end thereof by a guide slot 63 formed in the hollow arm 11. On this needle bar gate 62 a needle bar 66 is vertically movably attached, and on the lower end of the latter a needle 67 is fixed.

Figure 3:
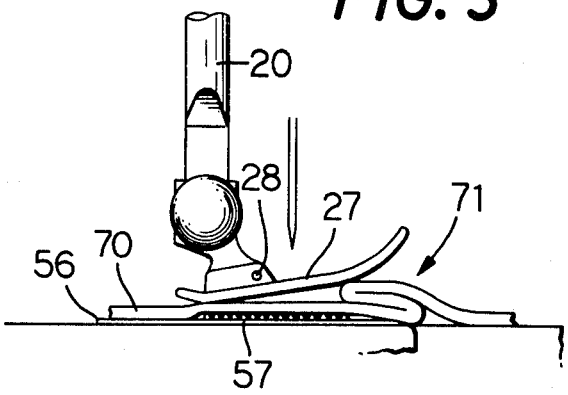
FIG. 3 is a side view of an essential part of the work presser device showing a state thereof when a stepped portion of a work piece is sewn.

In a sewing operation with a sewing machine of the above-mentioned structure, the presser foot 27 is, when it engages a stepped portion 71 of a work piece 70 as shown in FIG. 3, rotated about the pin 28 so as to be substantially inclined consequently lifting the presser bar 20. The lifting movement of the presser bar 20 will impart further curvature to the bent coil spring 40. The downward urging force applied to the presser bar 20, a pressure applied on the work piece 70 toward the feed dog 57, is not increased in its magnitude because the bent coil spring 40 is employed as a spring urging the presser bar 20 downwardly.

Figure 4:
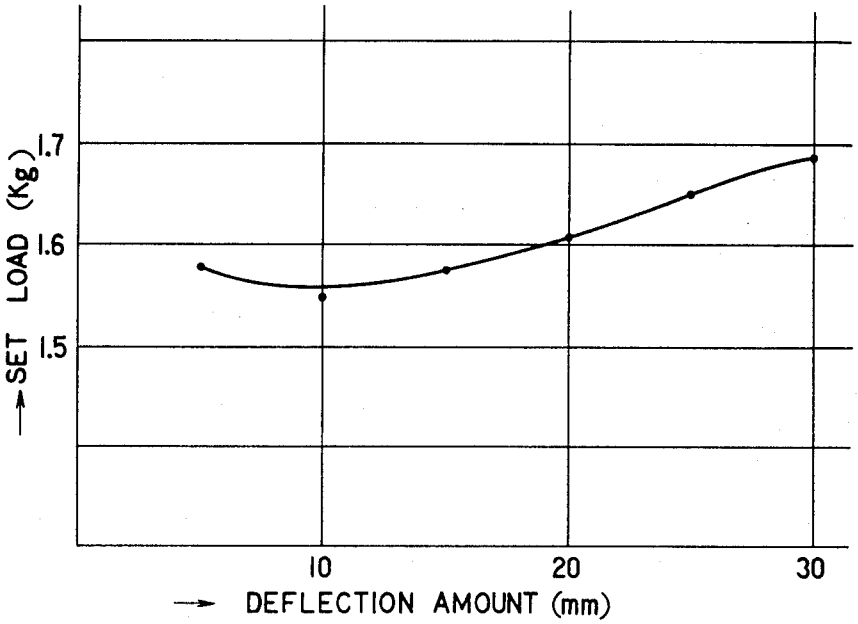
FIG. 4 is a graph showing the characteristic of a constant-force spring employed in the first embodiment.

In accordance with an experiment executed by the applicant with the bent coil spring 40, variation in load, that is variation in the resilient force active on the lower engaging portion 43, was ascertained to be very small, not more than 50 g as shown in the graph of FIG. 4, so long as the deflection amount of the spring 40, i.e., decrease of the relative distance of the lower engaging portion 43 to the upper engaging portion 43, is within the range of 8–16 mm. The variation amount can be seen to be very small in comparison to the set load of the spring 40 (approximately 1.55 Kg when the deflection amount is 8 mm). The bent coil spring 40 in this embodiment is disposed, depending on the experiment data, in a state where the deflection amount is 8 mm, when the presser bar 20 is lowest position; that is to say, when the presser foot 27 is in contact with the upper surface of the throat plate 56. And the lifting amount of the presser bar 20 for the purpose of inserting and removing the work piece, when it is raised to the uppermost position by the rotational movement of the presser lifting lever 32, is set at approximately 7 mm. This means that the thickness of the work piece allowed to be sewn in a sewing machine employing this embodiment is less than 7 mm, and that the work pressure can be maintained almost constant within the range of the work piece thickness. In ordinary sewing operations the work piece scarcely exceeds 7 mm in thickness.

Figure 5:
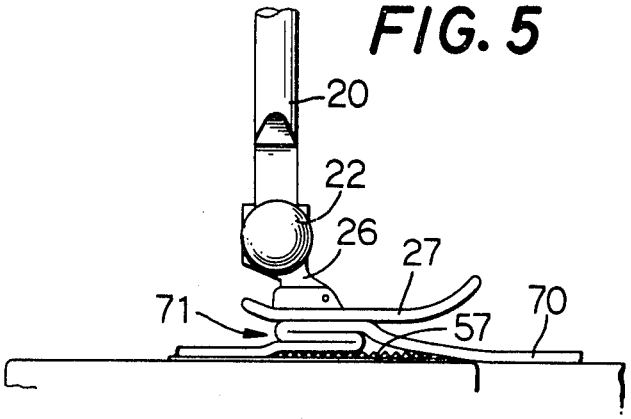
FIG. 5 is a side view of an essential part of the work presser device showing the state thereof when a stepped portion of a work piece is sewn.

Even when the presser foot 27 is slanted or inclined upon engagement with an abutment on the stepped portion 71 of the work piece 70 as shown in FIG. 3, the urging force applied on the presser bar 20 is nonetheless maintained at almost the same level as before. When the presser foot 27 has completely climbed up on the stepped portion 71 of the work piece 70, as shown in FIG. 5, the urging force remains substantially unchanged. In other words, a substantially constant pressure is applied on the work piece 70 during sewing of the stepped portion 71 as well as the remaining portion thereof. It results in complete elimination of staggering of work feeding by the feed dog 57 when the stepped portion 71 is sewed, by advantageously preventing an appearance of a stitch stalemate or a stitch lump.

It is preferable that the work pressure be always maintained constant irrespective of thickness variation of work pieces for fulfilling a smooth sewing operation. This object can be attained by the earlier mentioned automatic pressure regulating device in the prior art, but such a device is inevitably complicated in its structure and high in manufacturing cost because it employs ordinary compression coil spring for generating the necessary work pressure. In order to achieve the object by means of employing an ordinary compression coil spring, the whole length thereof must be changed by proper adjustment means according to the variation in the work piece thickness, which obliges complication of the structure of the device itself. For making this adjustment operation automatic, an electric servo mechanism or the like is needed, requiring the device to be all the more expensive.

In this embodiment the same object is achieved, contrary to the prior art, by employing the bent coil spring 40 and the attaching pieces therefor, i.e., the engaging plates 46, 48, etc. This simplification in structure and cost could be achieved in sum by employing the bent coil spring 40 in the urging means for generating the work pressure.

The imparting of a constant pressure on the work piece irrespective of any axial movement of the presser bar 20 makes sewing possible and easy where stepped portions sporadically appear or where stitching must be started at one edge of a thick work piece. It also assures that even in some special cases where the height from the bottom surface of the presser foot to the attaching portion thereof (a position corresponding to the location of the pin 28), is different from the ordinary presser foot, as for example, when the presser foot is changed to one for zigzag stitching or to the presser foot for button holding, the work pressure is maintained unchanged for achieving a stable and smooth feeding of the work piece.

Figure 6:
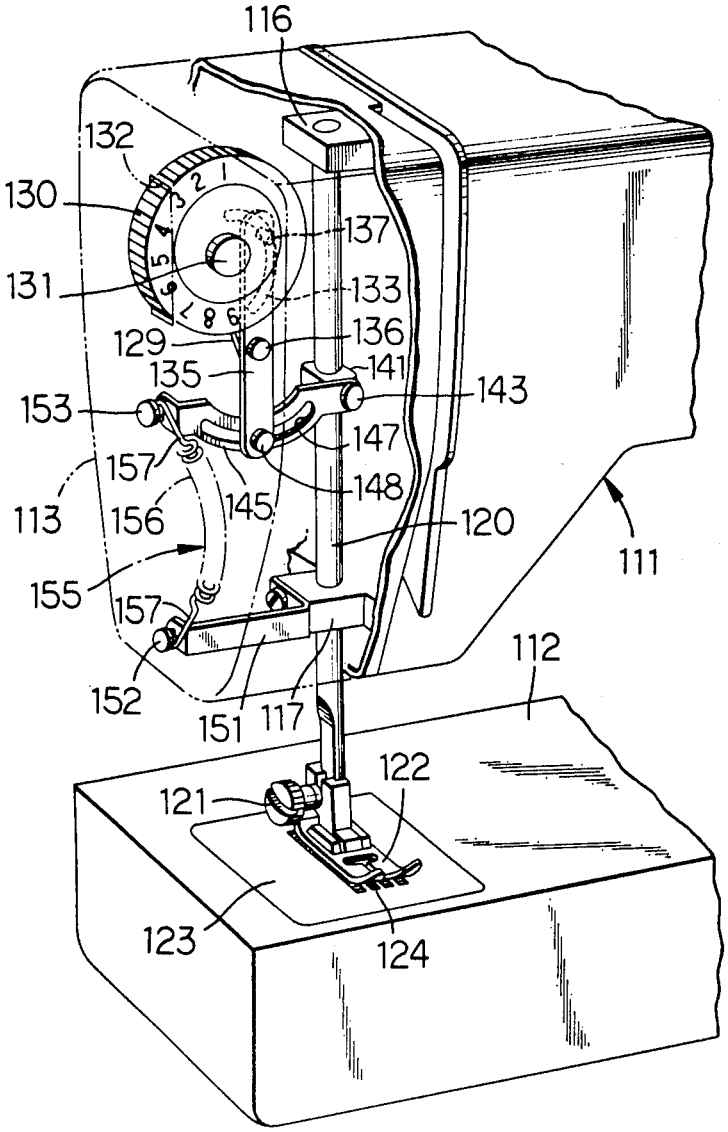
FIG. 6 is a perspective view of a second embodiment of this invention shown with the face plate partially broken away.

A second embodiment of the present invention, described with reference to FIG. 6, includes a presser bar 120 endwise movably supported by a pair of horizontally extended protrusions 116 and 117 from a hollow arm 111, and at the lower end portion of the presser bar 120 a presser foot 122 attached by a fastening screw 121. On a bed 112 a throat plate 123 is mounted opposite to the presser foot 122, and under the throat plate a feed dog 124 is mounted so as to feed or advance the work piece by intermittently protruding above the upper surface of the throat plate 123.

On a bracket 129 secured to the hollow arm 111, a dial 130 is rotatably mounted about a pivot 131. A part of the dial 130 is exposed outside a face plate 113 through an opening 132 formed therein. On the back surface of an opening 132 formed therein. On the back surface of the dial 130 a cam groove 133 is formed as illustrated with a phantom line in FIG. 6, and into the cam groove 133 is fitted a pin 137 secured to the upper end portion of an operation lever 135 which is pivoted at the middle thereof on the bracket 129 about a pivot 136. Between the dial 130 and the bracket 129 a spring washer is interposed for imparting to the dial 130 a certain rotational resistance.

On the middle part of the presser bar 120 a block 141 is secured, on which block an elongated link 145 of arcuate shape is rotatably attached with a pivot pin 143. In link 145, an elongated hole 147 of arcuate shape having its center at the axis of the pivot 136 is formed, into which hole is fitted a shaft pin 148 secured to the lower end portion of the operation lever 135. The rotation of the operation lever 135 about the pivot 136 will not cause the link 145 to be rotated about the pivot pin 143 regardless of positional change of the shaft pin 148 in the elongated hole 147. And the presser bar 120 in this embodiment is lifted up by an operation of the presser lifting lever which is similar to the lever 32 shown in FIG. 2.

On the protrusion 117 a bracket 151 of substantially L-shape is secured so as to be positioned right beneath the link 145. On both the free end of the bracket 151 and the link 145 a stepped pin 152, 153 is respectively mounted by screw threading, and between the two stepped pins a bent coil spring 155, designed as a constant-force spring, is anchored. This bent coil spring 155 consists of a coil portion 156 of closely wound coils and a pair of arm portions 157, 157 which respectively form a certain angle to the coil portion 156. The whole of the bent coil spring 155 is of arcuate shape and is rotatably connected, with an annular engaging portion formed on either end thereof, to the stepped pins 152 and 153. The urging force by the bent coil spring 155 is changed, by the rotational movement of the link 145 about the shaft pin 148, to a force which downwardly urges the presser bar 120.

The characteristic of the bent coil spring 155 in this embodiment is similar to that of the bent coil spring 40 in the first embodiment. When the deflection amount, that is the change in distance between both engaging portions on the tip of the pair of arm portions 157, 157 relative to each other, is within the range of 8–16 mm, variation in the spring load (resilient force) does not exceed 50 g. This variation amount can be seen to be very small in comparison to the set load of the spring (1.55 Kg when the deflection amount is 8 mm).

In this embodiment, dimensions of each member concerned are determined therefor such that the deflection amount of the bent coil spring 155 is 16 mm or less when the presser bar 120 is at the uppermost position, that is the free end of the link 145 is at a lowered position, regardless of where the shaft pin 148 is positioned in the elongated hole 147, and conversely the deflection amount of the bent coil spring 155 is 8 mm or more when the presser bar 120 is in abutment on the throat plate 123. An an almost constant resilient force of the bent coil spring 155, which is increased or decreased at a rate determined by the position of the shaft pin 148 on the link 145, acts as an urging force of the presser bar 120, that is to say, as the pressure applied to the work piece by the presser foot 122.

In a practical sewing operation the lever 135 is rotated in any one direction by the rotation of the dial 130 for changing the position of the shaft pin 148 which is the oscillation fulcrum of the link 145, so that the work pressure may be adapted to the work piece, the object of the sewing operation, and the stitching type. This suitable work pressure is empirically known in accordance with the thickness and kind of the work piece, stitching type, etc., and can be set easily and quantatively in this embodiment by means of rotating of the dial 130 under the guidance of graduations or scales marked thereon, which may be either predetermined numerals corresponding to the work pressure or numerals directly indicating the work pressure. And the magnitude of this work pressure is little influenced by the axial movement of the presser bar 120 and the presser foot 122 due to the presence of stepped portions in the course of sewing. In other words, the stepped portions are pressed by the presser foot 122 against the feed dog 124 under the same pressure as in the remaining non-stepped portion of the work piece, which insures the stable feeding operation by feed dog 124, and prevents the decreasing of the stitch length from the desired value as well as the producing of the stitch lumps.

When a larger work pressure is needed owing to the variation of the thickness and kind of the work piece, all that must be done is to rotate the dial 130 in a graduation increasing direction. It will cause the pin 137 to be engaged with part of the cam groove 133 nearer to the axis of the pivot 131, which rotates the operation lever 135 in a counterclockwise direction in FIG. 6 about the pivot 136. The position of the shaft pin 148 in the elongated hole 147 is changed rightwardly. This means that the fulcrum of the link 145 is shifted in an approaching direction to the presser bar 120 accompanied by increasing the urging force applied to the presser bar 120 by the bent coil spring 155.

When the dial 130 is rotated in a graduation dwindling direction the operation lever 135 is rotated in a clockwise direction, shifting the shaft pin 148 leftwardly in the elongated hole 147, which results in decreasing of the work pressure.

In other words, an almost constant resilient force of the bent coil spring 155 which is a constant-force spring, independently of the axial position of the presser bar 120, can be quantitatively adjusted with the aid of a regulating mechanism, consisting of a link 145, a shaft pin 148, an operation lever 135, a dial 130, etc.

Incidentally, the above-mentioned regulating mechanism is merely an example, and is by no means limited thereto. For example, a modification of the regulating mechanism wherein the engaging position of the constant-force spring to the link is changed is also permissible.

Figure 7:
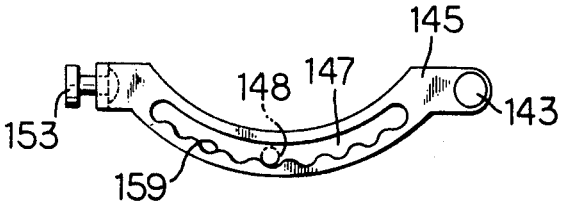
FIG. 7 is an elevational view of a link employed in a third embodiment of this invention.

A modification illustrated in FIG. 7, wherein a plurality of small recesses of arcuate shape with a radius almost identical to that of the shaft pin 148 are formed on the lower side of the elongated hole 147 of the link 145, is also permissible. In this case the work pressure may be varied stepwise: and furthermore the work pressure can be prevented from deviating from the set value due to vibration of the machine. In short, all that is essentially required is that the elongated hole 147 be substantially identical in shape to an arc having the center at the axis of the pivot 136, permitting alterations of the configuration according to the necessity.

Figure 8:
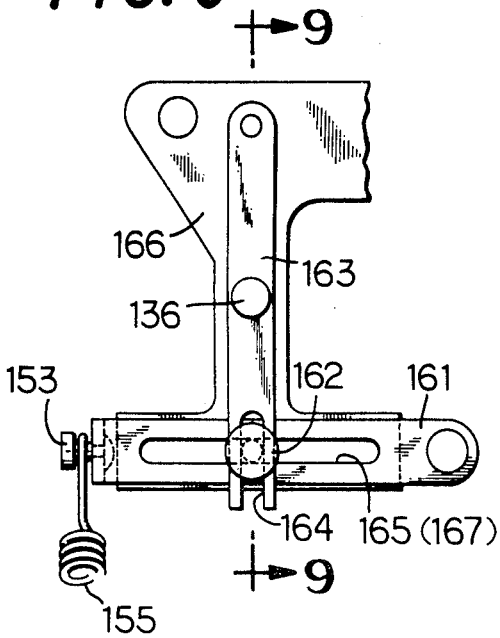
FIG. 8 is an elevational view of an essential part of a fourth embodiment of this invention.
Figure 9:
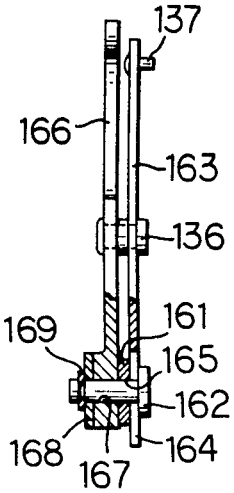
FIG. 9 is a sectional view of the fourth embodiment in FIG. 8 taken along the line 9—9 in FIG. 8.

As shown in FIGS. 8 and 9, use of a straight link 161 is also possible. In this embodiment, a shaft pin 162 with a head, which functions as a fulcrum for the link 161, is engaged through a vertically extending notch 164 formed in the lower end portion of an operation lever 163, an elongated hole 165 of the link 161, an elongated hole 167 formed in a bracket 166 and a flat washer 168, and is lockingly fastened by a snap ring 169. The resilient force of the constant-force spring 155 transmitted from the link 161 to the shaft pin 162 is received by the bracket 166, and the operation lever 163 exclusively functions to shift the position of the shaft pin 162.

What is claimed is:

1. A work presser device for a sewing machine provided with a feed mechanism having a feed dog operative through a throat plate to engage a work piece for advancing the latter, said work presser device including a presser bar mounted on a machine frame for axial movement, a presser foot attached to the lower end of said presser bar and means for urging said presser bar downwardly toward said throat plate and said feed dog, wherein the improvement comprises said urging means including a constant-force spring whose resilient force remains substantially constant within a certain range of deflection thereof, said constant-force spring having a closely wound intermediate coil portion and a pair of arm portions extending outwardly from the ends of said coil portion, said arm portions being pivotally connected at free end thereof to said presser bar and said machine frame, respectively, said constant-force spring having an arcuate shape so as to provide a constant force within said certain range of deflection in its connected state, said constant-force spring causing said presser foot to press the work piece with a substantially constant pressure irrespective of the axial movement of said presser bar due to variation in thickness of the work piece during a sewing operation.

2. A work presser device according to claim 1, wherein said constant-force spring applies the substantially constant force to said presser bar with the axial movement of the latter kept between a lower position in which said presser foot contacts with said throat plate and an upper position to which said presser foot is lifted for placing or removing the work piece under or from under said presser foot.

3. A work presser device for a sewing machine provided with a feed mechanism having a feed dog operative through a throat plate to engage a work piece for advancing the latter, said work presser device including a presser bar mounted on a machine frame for axial movement, a presser foot attached to the lower end of said presser bar and means for urging said presser bar downwardly toward said throat plate and said feed dog, wherein the improvement comprises:

said urging means including a constant-force spring whose resilient force remains substantially constant within a certain range of deflection thereof, said constant-force spring having a closely wound intermediate coil portion and a pair of arm portions extending outwardly from the ends of said coil portion, one of said arm portions being pivotally connected at a free end thereof to said machine frame, and means, disposed between the other arm portion and said presser bar, for regulating an urging force applied to said presser bar through the substantially constant resilient force of said spring, said other arm portion being pivotally connected at a free end thereof to said regulating means, said constant-force spring having an arcuate shape so as to provide a constant force within said certain range of deflection in its connected state, whereby during a sewing operation the work piece is pressed by said presser foot with a substantially constant pressure regulated by said regulating means, irrespectively of the axial movement of said presser bar due to variation in the thickness of the work piece.

4. A work presser device according to claim 3, wherein said regulating means comprises an oscillatable link lever connecting said other arm portion of said constant-force spring and said presser bar, a shaft pin shiftable on, and constituting an oscillation fulcrum of said lever, and a mechanism operatively connected to said shaft pin and manually operated to shift said shaft pin and thereby adjust the position of said oscillation fulcrum.

* * * * *